US006293360B1

(12) United States Patent
Liljebrand et al.

(10) Patent No.: US 6,293,360 B1
(45) Date of Patent: Sep. 25, 2001

(54) THREAD JOINT PERCUSSIVE DRILLING EQUIPMENT

(75) Inventors: Per-Olof Liljebrand, Sandviken; Urban Olsson, Forsbacka, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/275,004

(22) Filed: Mar. 24, 1999

(30) Foreign Application Priority Data

Mar. 24, 1998 (SE) ..... 9800995-4

(51) Int. Cl.[7] ..... E21B 17/00

(52) U.S. Cl. ..... 175/320; 285/334; 411/386

(58) Field of Search ..... 175/320, 323, 175/57; 166/42.6; 403/343, 307; 285/333, 334; 411/386, 411

(56) References Cited

U.S. PATENT DOCUMENTS

| | | | | |
|---|---|---|---|---|
| 3,645,570 | * | 2/1972 | Johansson et al. | 287/117 |
| 4,332,502 | * | 6/1982 | Wormald et al. | 403/343 |
| 4,625,814 | * | 12/1986 | Helasuo et al. | 175/57 |
| 4,687,368 | | 8/1987 | Eklof et al. . | |
| 4,968,068 | | 11/1990 | Larsson . | |
| 5,730,566 | * | 3/1998 | Goodwin et al. | 411/386 |
| 5,733,137 | * | 3/1998 | Knoop | 411/386 X |
| 5,791,849 | * | 8/1998 | Goodwin et al. | 411/386 |
| 6,095,266 | * | 8/2000 | Lundell | 175/417 |

FOREIGN PATENT DOCUMENTS 0 220 147 4/1987 (EP) .

* cited by examiner

*Primary Examiner*—Victor Batson
(74) *Attorney, Agent, or Firm*—Burns, Doane, Swecker & Mathis, L.L.P.

(57) ABSTRACT

A thread joint for percussive drilling equipment includes first and second percussive drill string components, the first component including a spigot. An external thread is formed on the spigot, and an internal thread is formed on the second component. Each of the internal and external threads includes an end section gradually transforming into a full thread section. The end section includes a pair of flanks, and the full thread section also includes a pair of flanks. Both flanks of the end section have a different profile than the corresponding flanks of the full thread section.

12 Claims, 3 Drawing Sheets

THREAD JOINT PERCUSSIVE DRILLING EQUIPMENT

BACKGROUND OF THE INVENTION

The present invention relates to a thread joint, a male portion, a female portion and a method for manufacturing a thread product for use in percussive drilling equipment.

PRIOR ART

In a conventional thread joint between two components in a rock drilling equipment for percussive drilling, one normally uses male and female threads that have been formed by cutting, see for example Swedish Patent No. 469,602 corresponds to (U.S. Pat. No. 4,687,368). At manufacturing of such a male thread a blank of steel is formed, which comprises a thick part having ends that connect to a clearance surface or a clearance groove of less diameter to receive at least portions of the threading tool and to an often conical free end. Subsequently, the tool's lateral and longitudinal feed are coordinated with the rotational movement of the thick portion such as to generate the thread in a conventional manner during at least one pass. Sharp edges are formed at the entrance and exit ends of the thread due to the geometries of the clearance groove and the free end surface. Corresponding sharp edges are formed when cutting a female thread.

The sharp edges result in the male and female threads damaging each other foremost at the free end of the respective drilling element during mounting and dismounting of the joint.

In addition, the threads are case hardened, and the sharp edges become hardened so much that the sharp edges define the area for the deepest case depth of the thread. Results from the hardening show cracking and fatigue in these areas during drilling, and therefore the lifespan of the joint becomes relatively short.

Another conventional thread joint between two components in a rock drilling equipment for percussive drilling and experience cracking is shown in EP Document 02 220 147 wherein the thread end is cut away to form a uniform thread size from one end to the other.

OBJECTS OF THE INVENTION

One object of the present invention is to provide a thread joint of the above-indicated type in which a longer tool life is attained.

Another object of the present invention is to provide a thread joint including entrances and exits with substantially the same case depth as in the rest of the thread joint.

Still another object of the present invention is to provide a thread joint the parts of which do not damage each other during mounting and dismounting.

Still another object of the present invention is to provide strong male and female portions.

Still another object of the present invention is to provide a method for manufacturing rock drilling products that have strong thread starts.

SUMMARY OF THE INVENTION

One aspect of the present invention relates to a thread joint which includes first and second drill string components, the first component including a spigot. A substantially cylindrical external thread is formed in the spigot. A substantially cylindrical internal thread is formed in the second component. Each of the internal and external threads includes an end section gradually transforming into a full thread section. The end section has a pair of flanks, and the full thread section also has a pair of flanks. In at least one of the internal and external threads, both flanks of the end section have different profiles than the corresponding flanks of the full thread section.

The invention also pertains to percussive drilling components having an external thread or an internal thread of the above-described type.

The invention also pertains to a method of manufacturing a percussive drilling component having a thread. The thread includes an end section gradually transforming into a full thread section. Each of the end and full thread sections includes two flanks. The method comprises the steps of:

A. providing a blank of metal in a machine for metallic machining,

B. providing a threading tool in the machine, and

C. coordinating longitudinal and lateral feed of the tool with rotational movement of the blank about an axis of rotation such that the thread is cut into the blank, with both flanks of the end section having respective profiles that are different from profiles of corresponding flanks of the full thread section.

BRIEF DESCRIPTION OF THE DRAWINGS

The objects of the invention are realized by a thread joint, a male portion, a female portion and a method for manufacturing a threaded product. Below, one embodiment of the invention will be described with reference to the drawings wherein.

DETAILED DESCRIPTION OF A PREFERRED EMBODIMENT OF THE INVENTION

Figure 1:
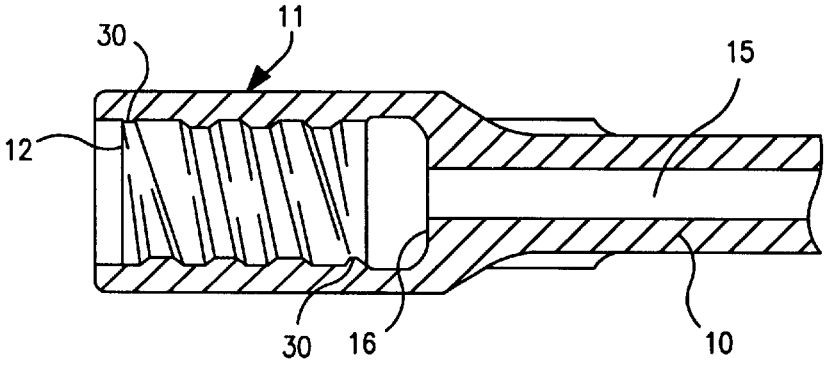
FIG. 1 shows a cross-section of an end of a female portion according to the present invention.
Figure 2A:
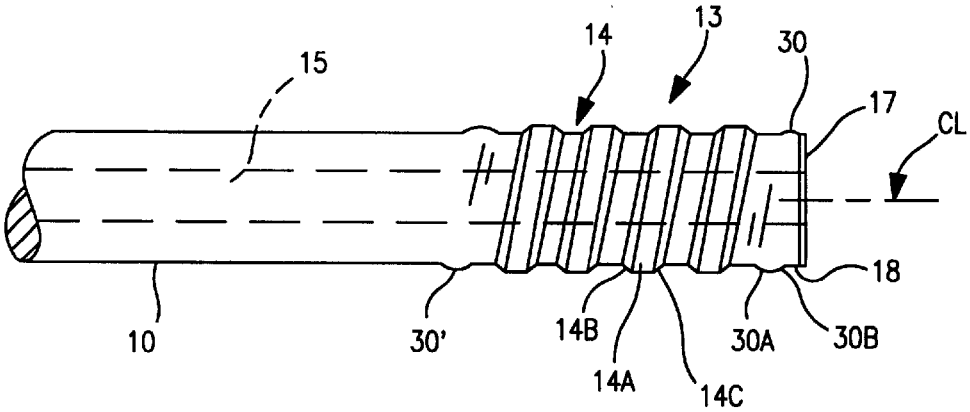
FIGS. 2A and 2B show an end of a male portion according to the present invention in a side view.
Figure 2B:
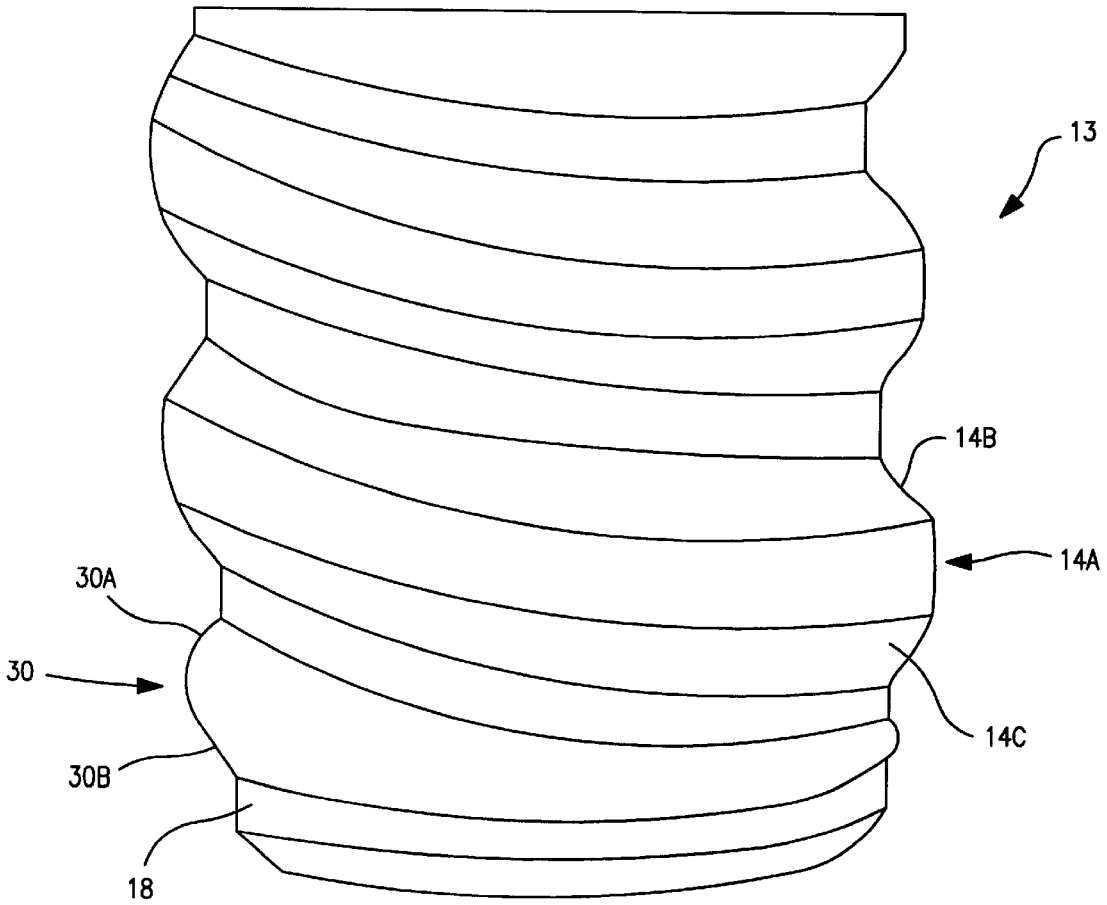
Figure 4:
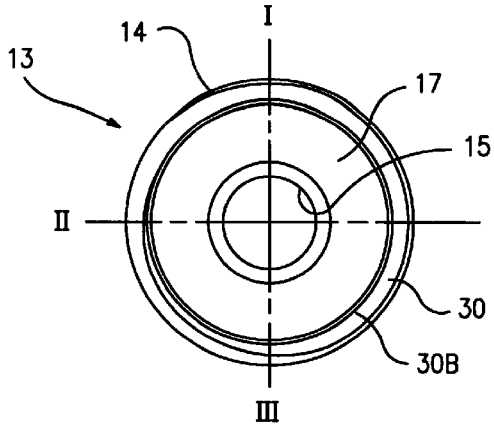
FIG. 4 shows an end view of the male portion.

The drill rod 10 for percussive drilling shown in FIGS. 1, 2A and 2B is provided at one end with a sleeve-shaped part or a female portion 11 having a female thread or internal thread 12 according to the present invention. The female portion 11 constitutes an integral part of the drill rod 10. At the other end the drill rod 10 is formed with a spigot or male portion 13 equipped with a male thread or external thread 14 according to the present invention. The drill rod further has a through-going flush channel 15, through which a flush medium, generally air or water, is conducted. The female portion 11 bottom forms a ring-shaped abutment surface 16, which when mounting two drill rods 10 is intended to abut against a corresponding annular abutment surface 17 disposed at the free end of the shank 13 of the other drill rod.

In FIGS. 4 and 5A–5D there are shown an end view of the male portion and different longitudinal cross-sections of an entrance end section 30 of the thread, as well as a finished full section of the thread 14 in the shape of a trapezoidal thread section 14A. The entrance end section 30 has a more rounded cross-section than the full thread section 14A. The cross-sections I, II, III and I are taken in respective planes containing the center axis CL of the male portion and spaced at ninety degree intervals (see FIG. 4). At the section I according to FIG. 5A, designated as 0°, the thread has not been intersected, so only the end surface 18 of the male portion is visible, which is usually conical.

Figure 5A:
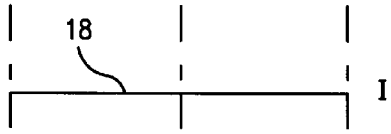
FIGS. 5A–5D show various cross-sections of a threaded component.
Figure 5B:
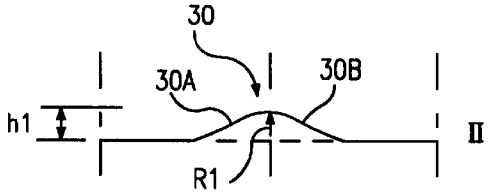

The entrance end section 30 shown in the section II according to FIG. 5B, taken at 90° from the section I counter-clockwise, describes a path which resembles a bell curve or the cross section of a symmetrical ridge having a smallest radius R1 bigger than 0.2 mm and a height h1. The entrance end section 30 comprises substantially identical flanks 30A and 30B.

Figure 5C:
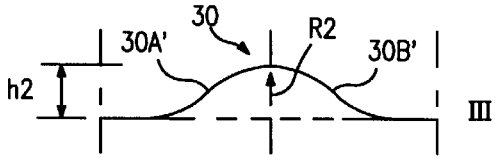
Figure 5D:
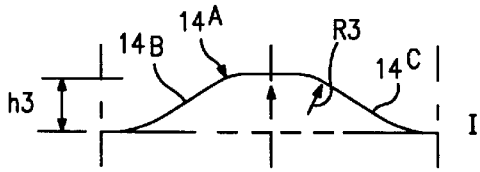

In the section III according to FIG. 5C, taken at 90° from the section II counterclockwise, the cross-sectional area has grown further in size, whereby the ridge and the flanks 30A', 30B' have a smallest radius R2 which is bigger than 0.2 mm and a height h2. In FIG. 5D according to the section I, i.e. 360° from the above-described section I, the entrance end section has entirely transformed into a finished or full thread section 14A of trapezoidal shape having a smallest radius R3 that is bigger than 0.2 mm and a height h3. The full thread section 14A has substantially identical flanks 14B and 14C.

It can be seen from FIGS. 5A–5D that both the cross-sectional area and the height of the entrance end section increase from the start between the sections I and II circumferentially to the finished thread section 14A while the smallest radius R1–R3 is never less than 0.2 mm. In case the finished thread section is a trapezoidal thread 14A then the smallest radius R2 of the entrance end section 30 in the section III is greater than the smallest radius R3 of the trapezoidal thread section 14A.

The exit end section 30' of the thread, shown at the left end of the thread in FIG. 2A, is of the same shape as the entrance end section 30.

Figure 6:
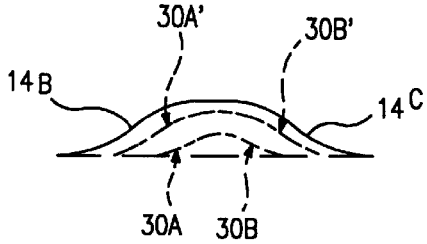
FIG. 6 shows all of the cross sections of FIGS. 5B–5D superimposed onto one another.

Since sharp edges do not exist at the entrance or exit end sections of the thread 14, the hardening depth at heat-treatment, for example case hardening, becomes essentially constant along the entire thread, and therefore cracks and fatigue are avoided in these areas. In conventional cut threads, one of the thread flanks at the end section always has the same profile as the corresponding flank of the full thread section, except for being somewhat lower (shorter). In contrast, both thread flanks 30A, 30B of the entrance end section (or the exit end section) of the present invention have respective profiles which differ from the profile of the corresponding flanks 14B and 14C, respectively, of the full thread section 14A, see FIG. 6. Preferably there are provided two entrances and two exits at the thread ends.

The invention also pertains to the female thread 12. That is, a soft (i.e., non-sharp) profile is attained at the entrance end section and exit end section of the female thread 12 corresponding to that of the entrance end section and exit end section of the male thread 14.

Figure 3:
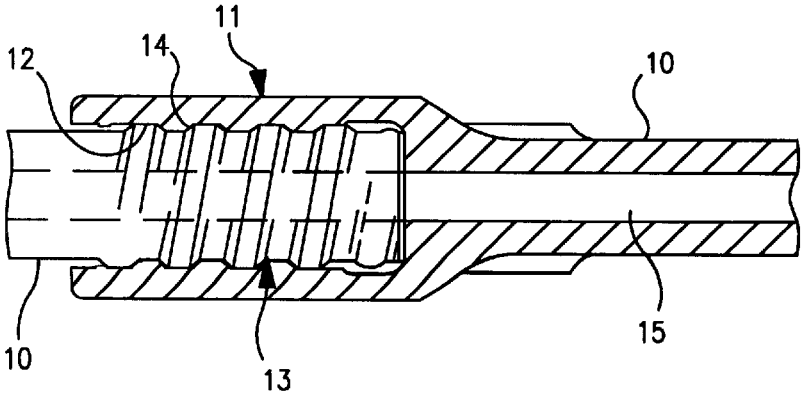
FIG. 3 shows a partly sectioned view of a thread joint according to the invention.

When a thread connection, FIG. 3, between two drill rods 10 according to the present invention is made, the free end of the male portion 13 will enter at the area of the free end of the female portion 11. In most cases the rods must be rotated relative to each other during insertion such that the threads can come into engagement with each other. As the rods are brought axially together, before threading starts, the soft (i.e., non-sharp) thread ends prevent the rods from damaging each other. Subsequently, the rods can be rotated until the front surface 17 of the male portion abuts against the bottom 16 of the female portion. The full thread sections 12 and 14 are designed in a conventional manner such that when they have been interconnected, abutment arises only at the straight flank portions 14B of the male thread and the corresponding flanks of the female thread. Consequently, contact between curved parts or between peaks and bottoms does not occur. In tests conducted, the thread joint according to the present invention has exhibited at least doubled tool life compared to conventional thread joints.

Turning (cutting) of the thread 12 or 14 is made in the following manner. In a conventional manner the lateral and longitudinal feed and cutting depth of the tool are coordinated with the rotational movement of the thick portion such that a thread is generated during at least one passage. This is attained by a thread master or via a threading program in a lathe. Having the threading tool deciding the thread profile substantially without being influenced by connecting clearances thereby attains soft entrances and exits at the thread ends. Subsequently at least the cut thread is heat treated, for example, by case hardening.

Conceivable Modifications of the Invention

Alternatively, the rod could be provided in the shape of a drill tube and could also comprise a shoulder abutment of the type illustrated in U.S. Pat. No. 4,968,068 which hereby is incorporated by reference into the description.

In the shown embodiment a trapezoidal thread is shown, but it is implicit that the invention can be utilized for all rock drilling threads, such as for example rope threads.

The female portion or the male portion could alternatively be integrated with a rock drill bit instead of with a drill rod or a drill rod.

The principles of the invention can be applied also in a thread joint between a shank adapter and the drill rod and between two drill rods with a loose threaded sleeve.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A percussive drilling equipment thread joint comprising:

first and second percussive drill string components, the first component including a spigot;

a substantially cylindrical external thread formed in the spigot;

a substantially cylindrical internal thread formed in the second component;

each of the internal and external threads including an end section gradually enlarging into a full thread section, the end section having a pair of flanks, and the full thread section having a pair of flanks;

both flanks of the end section of at least one of said internal and external threads having a different profile than the corresponding flanks of the full thread section.

2. The thread joint according to claim 1 wherein the end section of at least one of said internal and external threads has a more rounded cross-sectional shape than the corresponding full thread section; the end section of at least one of said internal and external threads having a height and a cross-sectional area, both the height and the cross-sectional area increasing gradually toward the full thread section; the flanks of the end section of at least one of said internal and external threads having identical profiles.

3. The thread joint according to claim 2 wherein a smallest radius of the end section of at least one of said internal and external threads is at least as large as a smallest radius of the full thread section.

4. The thread joint according to claim 1 wherein a smallest radius of the end section of at least one of said internal and external threads is at least as large as a smallest radius of the full thread section.

5. The thread joint according to claim 2 wherein a smallest radius of the end section of at least one of said internal and external threads is larger than 0.2 mm.

6. The thread joint according to claim 1 wherein a smallest radius of the end section of at least one of said internal and external threads is larger than 0.2 mm.

7. A percussive drilling component including a spigot having at least one substantially cylindrical external thread, the external thread including an end section gradually enlarging into a full thread section, the end section having a pair of flanks, and the full thread section having a pair of flanks, the flanks of the end section having a different profile than the corresponding flanks of the full thread section.

8. The percussive drilling component according to claim 7 wherein a height and a cross-sectional area of the end section progressively increase toward the full thread section; a smallest radius of the end section being larger than 0.2 mm and at least as larger as a smallest radius of the full thread section.

9. A percussive drilling component including a sleeve having at least one substantially cylindrical internal thread, the internal thread including an end section gradually enlarging into a full thread section, the end section having a pair of flanks, and the full thread section having a pair of flanks, the flanks of the end section having a different profile than the corresponding flanks of the full thread section.

10. The percussive drilling component according to claim 9 wherein a height and a cross-sectional area of the end section progressively increase toward the full thread section; a smallest radius of the end section being larger than 0.2 mm and at least as larger as a smallest radius of the full thread section.

11. A method of manufacturing a percussive drilling component having a thread, the thread including an end section gradually enlarging into a full thread section, each of the end and full thread sections including two flanks, the method comprising the steps of:

A) providing a blank of metal in a machine for metallic machining,

B) providing a threading tool in the machine, and

C) coordinating longitudinal and lateral feed of the tool with rotational movement of the blank about an axis of rotation such that the thread is cut into the blank, with both flanks of the end section having respective profiles that are different from profiles of corresponding flanks of the full thread section.

12. The method according to claim 11 further including the step of:

D) heat-treating at least the cut thread portion of the component.

* * * * *